US006427752B1

(12) United States Patent
Carter, Jr. et al.

(10) Patent No.: US 6,427,752 B1
(45) Date of Patent: Aug. 6, 2002

(54) CASTING SYSTEMS AND METHODS WITH AUXILIARY COOLING ONTO A LIQUIDUS PORTION OF A CASTING

(75) Inventors: William Thomas Carter, Jr., Galway; Mark Gilbert Benz, Burnt Hills; Robert John Zabala, Schenectady; Bruce Alan Knudsen, Amsterdam, all of NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 09/496,752

(22) Filed: Feb. 3, 2000

Related U.S. Application Data

(60) Provisional application No. 60/121,187, filed on Feb. 23, 1999.

(51) Int. Cl.[7] ..... B22D 23/00; B22D 11/124; B22D 11/00; B22D 27/02

(52) U.S. Cl. ..... 164/46; 164/486; 164/475; 164/66.1; 164/497; 164/444

(58) Field of Search ..... 164/46, 97, 486, 164/475, 66.1, 259, 415, 443; 29/527.5, 527.2

(56) References Cited

U.S. PATENT DOCUMENTS

| | | | | |
|---|---|---|---|---|
| 3,833,047 A | * | 9/1974 | Tovini | 164/66 |
| 4,612,649 A | | 9/1986 | Griebel, III et al. | |
| 5,160,532 A | * | 11/1992 | Benz et al. | 75/10.24 |
| 5,310,165 A | | 5/1994 | Benz et al. | |
| 5,325,906 A | | 7/1994 | Benz et al. | |
| 5,348,566 A | | 9/1994 | Sawyer et al. | |
| 5,381,847 A | * | 1/1995 | Ashok et al. | 164/46 |
| 5,472,177 A | | 12/1995 | Benz et al. | |
| 5,480,097 A | | 1/1996 | Carter, Jr. et al. | |
| 5,649,993 A | | 7/1997 | Carter, Jr. et al. | |
| 5,769,151 A | | 6/1998 | Carter, Jr. et al. | |
| 581,066 A | | 9/1998 | Knudsen et al. | |
| 5,809,057 A | | 9/1998 | Benz et al. | |

FOREIGN PATENT DOCUMENTS

| | | |
|---|---|---|
| EP | 01313181 | 12/1989 |
| GB | 2 174411 A | 11/1986 |

* cited by examiner

*Primary Examiner*—A. Alexandra Elve
*Assistant Examiner*—Kevin L. McHenry
(74) *Attorney, Agent, or Firm*—Robert P. Santandrea; Noreen C. Johnson

(57) ABSTRACT

A casting system with auxiliary cooling onto a liquidus portion of the casting can produce a metal casting that comprises a fine-grain, homogeneous microstructure. The microstructure is essentially oxide- and sulfide-free, segregation defect free, and essentially free of voids caused by air entrapped during solidification of the metal from a liquidus state to a solid state. The casting system with auxiliary cooling onto a liquidus portion of the casting can comprises an electroslag refining system as a source of liquid metal; a nucleated casting system; and at least one cooling system that supplies coolant onto a liquidus portion of the casting. The liquidus portion of the casting is cooled in a manner sufficient to provide a casting microstructure that comprises a fine-grain, homogeneous microstructure that is essentially oxide- and sulfide-free, segregation defect free, and essentially free of voids caused by air entrapped during solidification from a liquidus state to a solid state.

30 Claims, 5 Drawing Sheets

CASTING SYSTEMS AND METHODS WITH AUXILIARY COOLING ONTO A LIQUIDUS PORTION OF A CASTING

This application claims priority of a Provisional Application entitled "Clean Metal Nucleated Casting Systems and Methods" by Carter et al., U.S. Ser. No. 60/121,187, which was filed on Feb. 23, 1999.

BACKGROUND OF THE INVENTION

The invention relates to casting systems and methods with auxiliary cooling onto a liquidus portion of the casting. In particular, the invention related to clean metal nucleated casting systems and methods with auxiliary and direct cooling onto a liquidus portion of the casting.

Metals, such as iron-(Fe), nickel-(Ni), titanium-(Ti), and cobalt-(Co) based alloys, are often used in turbine component applications, in which fine-grained microstructures, homogeneity, and essentially defect-free compositions are desired. Problems in superalloy castings and ingots are undesirable as the costs associated with superalloy formation are high, and results of these problems, especially in ingots formed into turbine components are undesirable. Conventional systems for producing castings have attempted to reduce the amount of impurities, contaminants, and other constituents, which may produce undesirable consequences in a component made from the casting. However, the processing and refining of relatively large bodies of metal, such as superalloys, is often accompanied by problems in achieving homogeneous, defect-free structure. These problems are believed to be due, at least in part, to the bulky volume of the metal body and the amount and depth of the liquidus metal during the casting and solidification of the ingot.

One such problem that may often arise with respect to superalloys comprises controlling the grain size and other microstructure of the refined metals. Typically, refining processing involves multiple steps, such as sequential heating and melting, forming, cooling, and reheating of the large bodies of metal because the volume of the metal being refined is generally of at least about 5,000 pounds and can be greater than about 35,000 pounds. Further, problems of alloy or ingredient segregation also occur as processing is performed on large bodies of metal. Often, a lengthy and expensive sequence of processing steps is selected to overcome the above-mentioned difficulties, which arise through the use of bulk processing and refining operations of metals.

A known such sequence used in industry, involves vacuum induction melting; followed by electroslag refining (such as disclosed in U.S. Pat. Nos. 5,160,532; 5,310,165; 5,325,906; 5,332,197; 5,348,566; 5,366,206; 5,472,177; 5,480,097; 5,769,151; 5,809,057; and 5,810,066, all of which are assigned to the Assignee of the instant invention); followed, in turn, by vacuum arc refining (VAR) and followed, again in turn, by mechanical working through forging and drawing to achieve a fine microstructure. While the metal produced by such a sequence is highly useful and the metal product itself is quite valuable, the processing is quite expensive and time-consuming. Further, the yield from such a sequence can be low, which results in increased costs. Furthermore, the processing sequence does not ensure defect-free metals, and ultrasonic inspection is generally employed to identify and reject any components that include such defects, which results in further increase in costs.

A conventional electroslag refining process typically uses a refining vessel that contains a slag-refining layer floating on a layer of molten refined metal. An ingot of unrefined metal is generally used as a consumable electrode and is lowered into the vessel to make contact with the molten electroslag layer. An electric current is passed through the slag layer to the ingot and causes surface melting at the interface between the ingot and the slag layer. As the ingot is melted, oxide inclusions or impurities are exposed to the slag and removed at the contact point between the ingot and the slag. Droplets of refined metal are formed, and these droplets pass through the slag and are collected in a pool of molten refined metal beneath the slag. The refined metal may then be formed into a casting or ingot (collectively referred to hereinafter as "castings").

The above-discussed electroslag refining and the resultant casting may be dependent on a relationship between the individual process parameters, such as, but not limited to, an intensity of the refining current, specific heat input, and melting rate. This relationship involves undesirable interdependence between the rate of electroslag refining of the metal, metal ingot and casting temperatures, and rate at which a refined molten metal casting is cooled from its liquidus state to its solid state, all of which may result in poor metallurgical structure in the resultant casting.

Further, electroslag refining may not provide for the controlling of an amount and depth of the liquidus portion in a casting. A reduced solidification rate may result in the casting having properties and characteristics that are not desirable. For example, and in no way limiting, the undesirable characteristics may include inhomogeneous microstructure, defects including (but not limited to) impurities, voids and inclusions, segregations, and a porous (non-dense) material resulting from entrapped air due to slow solidification.

Another problem that may be associated with conventional electroslag refining processing comprises the formation of a relatively deep metal pool in an electroslag crucible. A deep melt pool causes a varied degree of ingredient macrosegregation in the metal that leads to a less desirable microstructure, such as a microstructure that is not a fine-grained microstructure, or segregation of the elemental species so as to form an inhomogeneous structure. A subsequent processing operation has been proposed in combination with the electroslag refining process to overcome this deep melt pool problem. This subsequent processing may be vacuum arc remelting (VAR). Vacuum arc remelting is initiated when an ingot is processed by vacuum arc steps to produce a relatively shallow melt pool, whereby an improved microstructure, which may also possess a lower hydrogen content, is produced. Following the vacuum arc refining process, the resulting ingot is then mechanically worked to yield a metal stock having a desirable fine-grained microstructure. Such mechanical working may involve a combination of steps of forging, drawing, and heat treatment. This thermo-mechanical processing requires large, expensive equipment, as well as costly amounts of energy input.

An attempt to provide a desirable casting microstructure has been proposed in U.S. Pat. No. 5,381,847, in which a vertical casting process attempts to control grain microstructure by controlling dendritic growth. The process may be able to provide a useable microstructure for some applications, however, the vertical casting process does not control the source metal contents, including but not limited to impurities, oxides, and other undesirable constituents. The process, as set forth in the patent, does not control the depth or the liquidus portion or provide anything to enhance the solidification rate of the casting, which may adversely impact the casting's microstructure and characteristics.

Therefore, a need exists to provide a metal casting process that produces a casting with a relatively homogeneous, fine-grained microstructure, in which the process does not rely upon multiple processing steps that controls the depth of the liquidus portion of the casting. Further, a need exists to provide a metal casting system that produces a casting with a relatively homogeneous, oxide-free, fine-grained microstructure. Also, a need exists to provide a metal casting process and system that produces a casting that is essentially free of oxides and/or entrapped air due to slow solidification rates.

SUMMARY OF THE INVENTION

An aspect of the invention sets forth a casting system for producing a metal casting. The casting system comprises auxiliary cooling onto a liquidus portion of the casting and can produce a metal casting that comprises a fine-grain, homogeneous microstructure. The microstructure is essentially oxide- and sulfide-free, segregation defect free, and essentially free of voids caused by air entrapped during solidification of the metal from a liquidus state to a solid state. The casting system with auxiliary cooling onto a liquidus portion of the casting can comprise an electroslag refining system; source of liquid metal, such as a nucleated casting system; and at least one cooling system that supplies coolant onto a liquidus portion of the casting. The casting is cooled in a manner sufficient to provide a microstructure that comprises a fine-grain, homogeneous microstructure that is essentially oxide- and sulfide-free, segregation defect free, and essentially free of voids caused by air entrapped during solidification from a liquidus state to a solid state.

A further aspect of the invention provides a method for forming a metal casting using auxiliary cooling onto a liquidus portion of the casting. The method produces a metal casting that comprises a fine-grain, homogeneous microstructure that is essentially oxide- and sulfide-free, segregation defect free, and essentially free of voids caused by air entrapped during solidification of the metal from a liquidus state to a solid state. The method comprises forming a source of clean refined metal that has oxides and sulfides refined out by electroslag refining; forming the casting by a nucleated casting process; and cooling a liquidus portion of the casting. The cooling comprises directing coolant onto the liquidus portion of the casting, wherein the step of cooling is sufficient to provide a microstructure that comprises a fine-grain, homogeneous microstructure that is essentially oxide- and sulfide-free, segregation defect free, and essentially free of voids caused by air entrapped during solidification from a liquidus state to a solid state.

These and other aspects, advantages and salient features of the invention will become apparent from the following detailed description, which, when taken in conjunction with the annexed drawings, where like parts are designated by like reference characters throughout the drawings, disclose embodiments of the invention.

DESCRIPTION OF THE INVENTION

Figure 1:
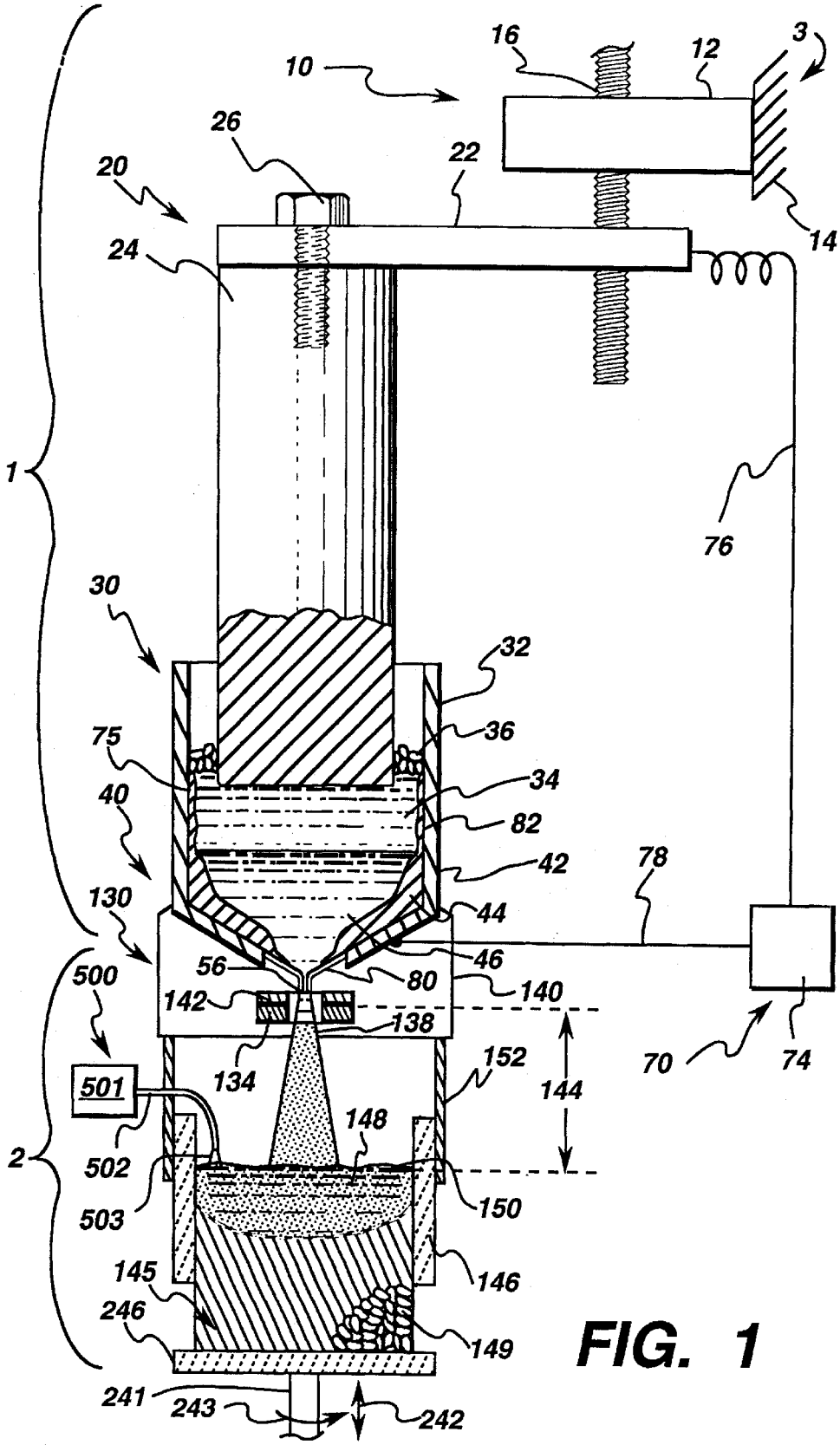
FIG. 1 is a schematic illustration of a clean metal nucleated casting system with auxiliary cooling onto a liquidus portion of the casting having cooling system, an electroslag refining system, and nucleated casting system.

Casting systems and methods with auxiliary cooling onto a liquidus portion of the casting, as embodied by the invention, can be provided on casting systems, such as, but not limited to, vertical casting systems and casting systems that include vertical casting with electroslag refining and cold-induction guides. The systems and methods with auxiliary cooling onto a liquidus portion of the casting will be described hereinafter with respect to vertical casting with electroslag refining and cold-induction guides, as illustrated in FIGS. 1–4. However, this description is not intended to limit the invention in any way, and the scope of the invention comprises casting systems and methods with auxiliary cooling onto a liquidus portion of the casting with other metal formation processes and systems.

The casting systems and methods with auxiliary cooling onto a liquidus upper portion (liquidus portion) of the casting, and alternatively, auxiliary and direct cooling onto a liquidus portion of the casting (hereinafter referred to as "auxiliary cooling onto the liquidus portion") can produce a casting with essentially oxide free and impurity free characteristics. The casting that is formed can also be dense and essentially non-porous. The term "casting" includes any casting, such as a preform, ingot, and the like. The term "essentially free" means that any constituents in the material do not adversely influence the material, for example its strength and related characteristics, and the term "essentially non-porous" means that the material is dense, amounts of entrapped air are minimal, and does not adversely influence the material.

The clean-liquid metal source for the casting systems and methods with auxiliary cooling onto a liquidus portion of the casting, as embodied by the invention, can comprise any appropriate liquid metal source, such as, but not limited to, an electroslag refining apparatus, which can provide a clean liquid metal due to the electroslag refining steps. For example, and in no way limiting the invention, the electroslag refining apparatus can comprise an electroslag refining (ESR) system in cooperation with a cold-induction guide (CIG), as set forth in the above-mentioned patents to the Assignee of the instant invention.

Alternatively, the source for the casting systems and methods with auxiliary cooling onto a liquidus portion of the casting can comprise a vertical casting arrangement, as disclosed in U.S. Pat. No. 5,381,847. Therefore, a nucleated casting system may permit a plurality of molten metal droplets to be formed and pass through a cooling zone, which is formed with a length sufficient to allow up to about 30 volume percent of each of the droplets to solidify on average. The droplets are then received by a mold and solidification of the metal droplets is completed in the mold, such as, but not limited to, auxiliary cooling, as embodied by the invention. The droplets retain liquid characteristics and readily flow within the mold, when less than about 30 volume percent of the droplets is solid.

In order to enhance the solidification rate of the liquidus portion of the metal, the casting systems and methods, as embodied by the invention, provide coolant directly onto the liquidus (upper) portion of the casting to enhance cooling of the liquidus portion of the casting. The coolant will reduce the temperature of the liquidus portion of the casting, and provide expedited cooling and enhanced solidification of the liquidus portion of the casting. The expedited cooling and enhanced solidification of the liquidus portion will reduce the amount of entrapped gas that can be generated during operation or retained therein, thus forming a dense casting that contains few entrapped gas voids. Further, the expedited cooling and enhanced solidification rates of the liquidus portion will enhance the microstructural characteristics of the casting by reducing the grain size, providing an essentially segregation free microstructure, and a homogeneous microstructure. The auxiliary cooling onto a liquidus portion of the casting, as embodied by the invention, can produce a casting possessing a homogeneous, fine-grained microstructure for many metals and alloys, including, but not limited to, nickel-(Ni) and cobalt-(Co) based superalloys, iron-(Fe), titanium-(Ti), alloys, which are often used in turbine component applications. The castings formed by the auxiliary cooling onto a liquidus portion of the casting, as embodied by the invention, can be converted into a final casting, a billet, or directly forged with reduced processing and heat treatment steps, due to their homogeneous, fine-grained microstructure.

Accordingly, a casting method including auxiliary cooling onto a liquidus portion of the casting can be used to produce high quality forgings that can be used in many applications, such as but not limited to rotating equipment applications, such as, but not limited to, disks, rotors, blades, vanes, wheel, buckets, rings, shafts, wheels, and other such elements, and other turbine component applications. The description of the invention will refer to turbine components formed from castings, however, this is merely exemplary of the applications within the scope of the invention.

Figure 2:
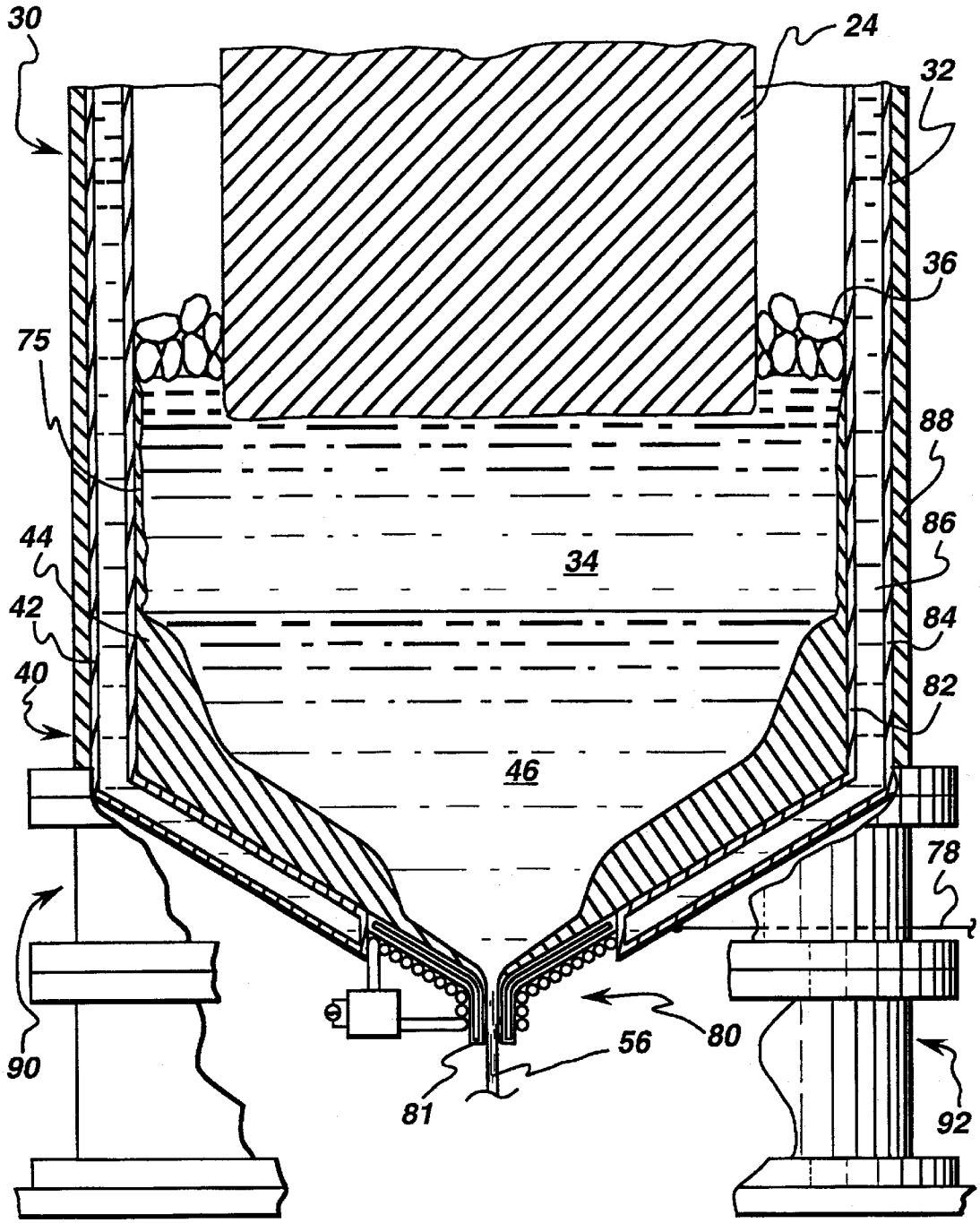
FIG. 2 is a partial schematic, vertical sectional illustration of the clean metal nucleated casting system, as illustrated in FIG. 1, that illustrates details of the electroslag refining system.
Figure 3:
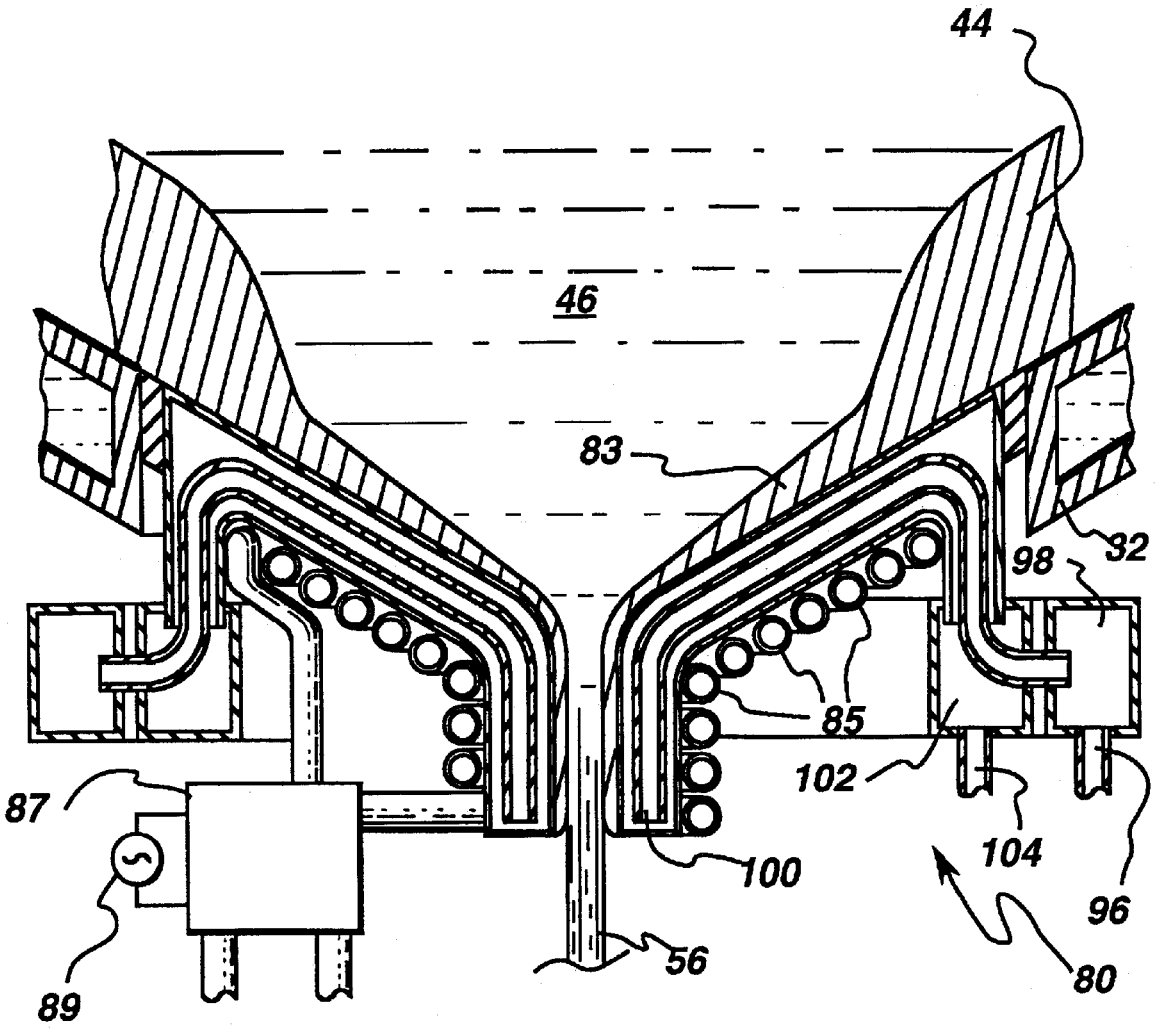
FIG. 3 is a partial schematic, vertical section illustration in detail of the electroslag refining system of the clean metal nucleated casting system for producing a casting.
Figure 4:
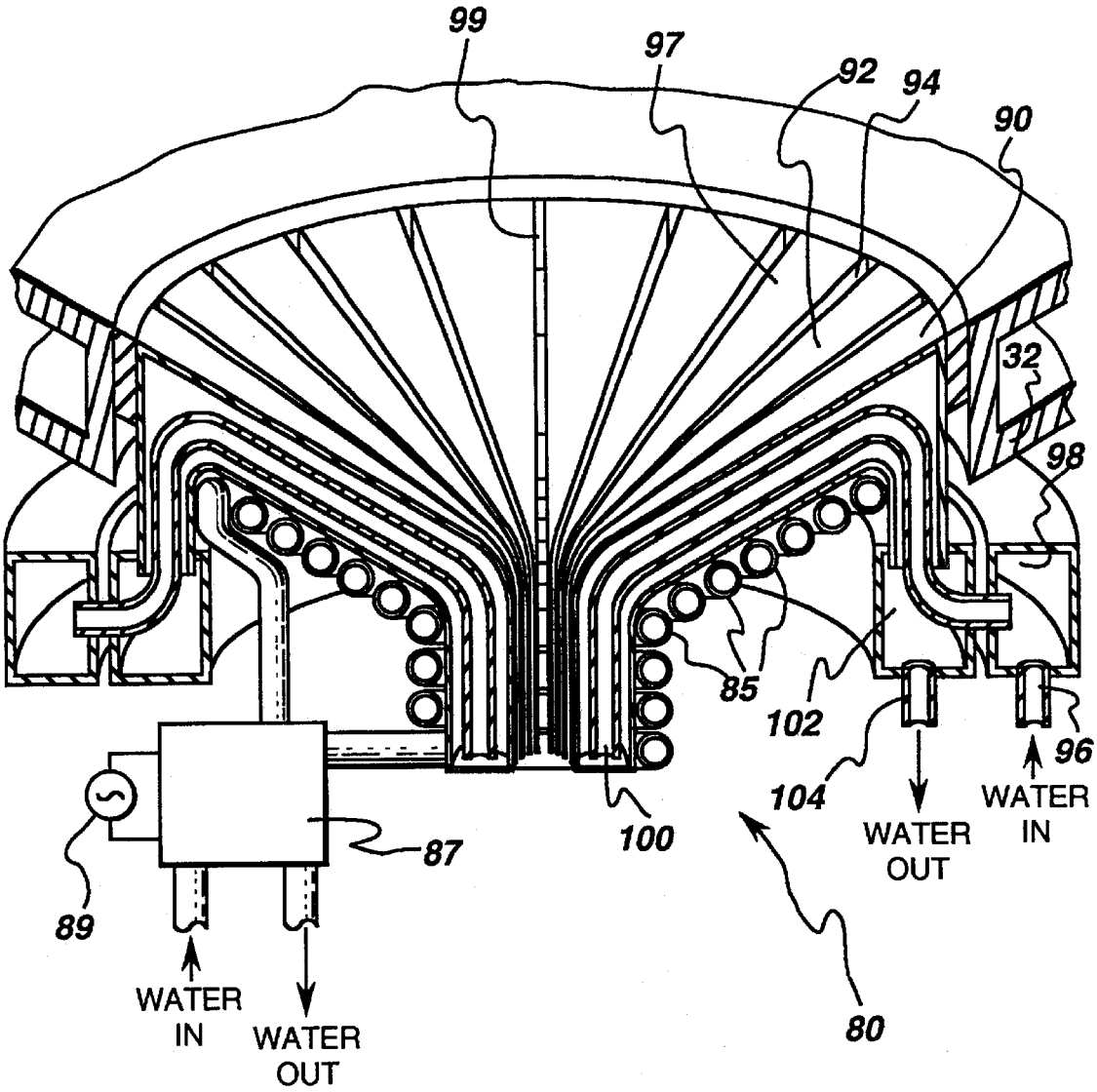
Prior Art FIG. 4
FIG. 4 is a partial schematic, part sectional illustration of the electroslag refining system of the clean metal nucleated casting system for producing a casting.

Referring to the accompanying drawings, FIG. 1 illustrates a semischematic, part-sectional, elevational view of an exemplary casting system 3 with auxiliary cooling onto a liquidus portion of the casting by a cooling system 500, as embodied by the invention. FIGS. 2–4 illustrate details of features illustrated in FIG. 1. The casting system 3 will be initially discussed with a description of the electroslag refining system 1 and the nucleated casting system 2 to facilitate the understanding of the invention.

FIG. 1 is a schematic illustration of a casting system 3 with an auxiliary cooling system 500 for cooling of a liquidus portion of the casting, as embodied by the invention, for producing a casting 145. In FIG. 1, the metal for the clean metal nucleated casting system 3 and its associated clean metal nucleated casting processes is provided by an electroslag refining system 1. The clean metal is fed to a nucleated casting system 2. The electroslag refining system 1 and nucleated casting system 2 cooperate to form a clean metal nucleated casting system 3, which in turn forms the auxiliary cooling onto a liquidus portion of the casting, as embodied by the invention.

The electroslag refining system 1 introduces a consumable electrode 24 of metal to be refined directly into an electroslag refining system 1, and refines the consumable electrode 24 to produce a clean, refined metal melt 46 (hereafter "clean metal"). The source of metal for the electroslag refining system 1 as a consumable electrode 24 is merely exemplary, and the scope of the invention comprises, but is not limited to, the source metal comprising an ingot, melt of metal, powder metal, and combinations thereof. The description of the invention will refer to a consumable electrode, however this is merely exemplary and is not intended to limit the invention in any manner. The clean metal 46 is received and retained within a cold hearth structure 40 that is mounted below the electroslag refining apparatus 1. The clean metal 46 is dispensed from the cold hearth structure 40 through a cold finger orifice structure 80 that is mounted and disposed below the cold hearth structure 40.

The electroslag refining system 1 can provide essentially steady state operation in supplying clean metal 46 if the rate of electroslag refining of metal and rate of delivery of refined metal to a cold hearth structure 40 approximates the rate at which molten metal 46 is drained from the cold hearth structure 40 through an orifice 81 of the cold finger orifice structure 80. Thus, the clean metal nucleated casting process can operate continuously for an extended period of time and, accordingly, can process a large bulk of metal. Alternatively, the clean metal nucleated casting process can be operated intermittently by intermittent operation of one or more of the features of the clean metal nucleated casting system 3.

Once the clean metal 46 exits the electroslag refining system 1 through the cold finger orifice structure 80, it enters into the nucleated casting system 2. Then, the clean metal 46 can be further processed to produce a relatively large ingot of refined metal. Alternatively, the clean metal 46 may be processed through to produce smaller castings, ingots, castings, or formed into continuous cast castings. The clean metal nucleated casting process effectively eliminates many of the processing operations, such as those described above that, until now, have been necessary in order to produce a metal casting having a desired set of material characteristics and properties.

In FIG. 1, a vertical motion control apparatus 10 is schematically illustrated. The vertical motion control apparatus 10 comprises a box 12 mounted to a vertical support 14 that includes a motive device (not illustrated), such as but not limited to a motor or other mechanism. The motive device is adapted to impart rotary motion to a screw member 16. An ingot support structure 20 comprises a member, such as but not limited to a member 22, that is threadedly engaged at one end to the screw member 16. The member 22 supports the consumable electrode 24 at its other end by an appropriate connection, such as, but not limited to, a bolt 26.

An electroslag refining structure 30 comprises a reservoir 32 that is cooled by an appropriate coolant, such as, but not limited to, water. The reservoir 32 comprises a molten slag 34, in which an excess of the slag 34 is illustrated as the solid slag granules 36. The slag composition used in the clean metal nucleated casting process will vary with the metal being processed. A slag skull 75 may be formed along inside surfaces of an inner wall 82 of reservoir 32, due to the cooling influence of the coolant flowing against the outside of inner wall 82, as described hereinafter.

A cold hearth structure 40 (FIGS. 1–3) is mounted below the electroslag refining structure 30. The cold hearth structure 40 comprises a hearth 42, which is cooled by an appropriate coolant, such as water. The hearth 42 contains a skull 44 of solidified refined metal and a body 46 of refined liquid metal. The reservoir 32 may be formed integrally with the hearth 42. Alternatively, the reservoir 32 and hearth 42 may be formed as separate units, which are connected to form the electroslag refining system 1.

A bottom orifice 81 of the electroslag refining system 1 is provided in the cold finger orifice structure 80, which is described with reference to FIGS. 3 and 4. A clean metal 46, which is refined by the electroslag refining system 1 so as to be essentially free of oxides, sulfides, and other impurities, can traverse the electroslag refining system 1 and flow out of the orifice 81 of the cold finger orifice structure 80.

A power supply structure 70 can supply electric refining current to the electroslag refining system 1. The power supply structure 70 can comprise an electric power supply and control mechanism 74. An electrical conductor 76 that is able to carry current to the member 22 and, in turn, carry current to the consumable electrode 24 connects the power supply structure 70 to the member 22. A conductor 78 is connected to the reservoir 32 to complete a circuit for the power supply structure 70 of the electroslag refining system 1.

FIG. 2 is a detailed part-sectional illustration of the electroslag refining structure 30 and the cold hearth structure 40 in which the electroslag refining structure 30 defines an upper portion of the reservoir 32 and the cold hearth structure 40 defines a lower portion 42 of the reservoir 32. The reservoir 32 generally comprises a double-walled reservoir, which includes an inner wall 82 and outer wall 84. A coolant 86, such as but not limited to water, is provided between the inner wall 82 and outer wall 84. The coolant 86 can flow to and through a flow channel, which is defined between the inner wall 82 and outer wall 84 from a supply 98 (FIG. 3) and through conventional inlets and outlets (not illustrated in the figures). The cooling water 86 that cools the wall 82 of the cold hearth structure 40 provides cooling to the electroslag refining structure 30 and the cold hearth structure 40 to cause the skull 44 to form on the inner surface of the cold hearth structure 40. The coolant 86 is not essential for operation of the electroslag refining system 1, clean metal nucleated casting system 3, or electroslag refining structure 30. Cooling may insure that the liquid metal 46 does not contact and attack the inner wall 82, which may cause some dissolution from the wall 82 and contaminate the liquid metal 46.

In FIG. 2, the cold hearth structure 40 also comprises an outer wall 88, which may include flanged tubular sections, 90 and 92. Two flanged tubular sections 90 and 92 are illustrated in the bottom portion of FIG. 2. The outer wall 88 cooperates with the nucleated casting system 2 to form a controlled atmosphere environment 140, which is described hereinafter.

The cold hearth structure 40 comprises a cold finger orifice structure 80 that is shown detail FIGS. 3 and 4. The cold finger orifice structure 80 is illustrated in FIG. 3 in relation to the cold hearth structure 40 and a stream 56 of liquid melt 46 that exits the cold hearth structure 40 through the cold finger orifice structure 80. The cold finger orifice structure 80 is illustrated (FIGS. 2 and 3) in structural cooperation with the solid metal skull 44 and liquid metal 46. FIG. 4 illustrates the cold finger orifice structure 80 without the liquid metal or solid metal skull, so details of the cold finger orifice structure 80 are illustrated.

The cold finger orifice structure 80 comprises the orifice 81 from which processed molten metal 46 is able to flow in the form of a stream 56. The cold finger orifice structure 80 is connected to the cold hearth structure 40 and the cold hearth structure 30. Therefore, the cold hearth structure 40 allows processed and generally impurity-free alloy to form the skulls 44 and 83 by contacting walls of the cold hearth structure 40. The skulls 44 and 83 thus act as a container for the molten metal 46. Additionally, the skull 83 (FIG. 3), which is formed at the cold finger orifice structure 80, is controllable in terms of its thickness, and is typically formed with a smaller thickness than the skull 44. The thicker skull 44 contacts the cold hearth structure 40 and the thinner skull 83 contacts the cold finger orifice structure 80, and the skulls 44 and 83 are in contact with each other to form an essentially continuous skull.

A controlled amount of heat may be provided to the skull 83 and thermally transmitted to the liquid metal body 46. The heat is provided from induction heating coils 85 that are disposed around the cold hearth structure. An induction-heating coil 85 can comprise a cooled induction-heating coil, by flow of an appropriate coolant, such as water, into it from a supply 87. Induction heating power is supplied from a power source 89, which is schematically illustrated in FIG. 3. The construction of the cold finger orifice structure 80 permits heating by induction energy to penetrate the cold finger orifice structure 80 and heat the liquid metal 46 and skull 83, and maintain the orifice 81 open so that the stream 56 may flow out of the orifice 81. The orifice may be closed by solidification of the stream 56 of liquid metal 46 if heating power is not applied to the cold finger orifice structure 80. The heating is dependent on each of the fingers of the cold finger orifice structure 80 being insulated from the adjoining fingers, for example being insulated by an air or gas gap or by a suitable insulating material.

The cold finger orifice structure 80 is illustrated in FIG. 4, with both skulls 44 and 83 and the molten metal 46 are omitted for clarity. An individual cold finger 97 is separated from each adjoining finger, such as finger 92, by a gap 94. The gap 94 may be provided and filled with an insulating material, such as, but not limited to, a ceramic material or insulating gas. Thus, the molten metal 46 (not illustrated) that is disposed within the cold finger orifice structure 80 does not leak out through the gaps, because the skull 83 creates a bridge over the cold fingers and prevents passage of liquid metal 46 therethrough. Each gap extends to the bottom of the cold finger orifice structure 80, as illustrated in FIG. 4, which illustrates a gap 99 aligned with a viewer's line-of-sight. The gaps can be provided with a width in a range from about of 20 mils to about 50 mils, which is sufficient to provide an insulated separation of respective adjacent fingers.

The individual fingers may be provided with a coolant, such as water, by passing coolant into a conduit 96 from a suitable coolant source (not shown). The coolant is then passed around and through a manifold 98 to the individual cooling tubes, such as cooling tube 100. Coolant that exits the cooling tube 100 flows between an outside surface of the cooling tube 100 and an inside surface of a finger. The coolant is then collected in a manifold 102, and passed out of the cold finger orifice structure 80 through a water outlet tube 104. This individual cold finger water supply tube arrangement allows for cooling of the cold finger orifice structure 80 as a whole.

The amount of heating or cooling that is provided through the cold finger orifice structure 80 to the skulls 44 and 83, as well as to the liquid metal 46, can be controlled to control the passage of liquid metal 46 through the orifice 81 as a stream 56. The controlled heating or cooling is done by controlling the amount of current and coolant that pass in the induction coils 85 to and through the cold finger orifice structure 80. The controlled heating or cooling can increase or decrease the thickness of the skulls 44 and 83, and to open or close the orifice 81, or to reduce or increase the passage of the stream 56 through the orifice 81. More or less liquid metal 46 can pass through the cold finger orifice structure 80 into the orifice 81 to define the stream 56 by increasing or decreasing the thickness of the skulls 44 and 83. The flow of the stream 56 can be maintained at a desirable balance, by controlling coolant water and heating current and power to and through the induction heating coil 85 to maintain the orifice 81 at a set passage size along with controlling the thickness of the skulls 44 and 83.

The operation of the electroslag refining system 1 of the clean metal nucleated casting system 3 will now be generally described with reference to the figures. The electroslag refining system 1 of the clean metal nucleated casting system 3 can refine ingots that can include defects and impurities. A consumable electrode 24 is melted by the electroslag refining system 1. The consumable electrode 24 is mounted in the electroslag refining system 1 in contact with molten slag in the electroslag refining system. Electrical power is provided to the electroslag refining system and ingot. The power causes melting of the ingot at a surface where it contacts the molten slag and the formation of molten drops of metal. The drops are collected after they pass through the molten slag as a body of refined liquid metal in the cold hearth structure 40 below the electroslag refining structure 30. Oxides, sulfides, contaminants, and other impurities that originate in the consumable electrode 24 are removed through dissolution in to the slag as the droplets form on the surface of the ingot and pass through the molten slag. The molten drops are drained from the electroslag refining system 1 at the orifice 81 in the cold finger orifice structure 80 as a stream 56. The stream 56 that exits the electroslag refining system 1 of the clean metal nucleated casting system 3 that forms castings comprises a refined melt that is essentially free of oxides, sulfides, contaminants, and other impurities.

The rate at which the metal stream 56 exits the cold finger orifice structure 80 can further be controlled by controlling a hydrostatic head of liquid metal 46 above the orifice 81. The liquid metal 46 and slag 44 and 83 that extend above the orifice 81 of the cold finger orifice structure 80 define the hydrostatic head. If a clean metal nucleated casting system 3 with an electroslag refining system 1 is operated with a given constant hydrostatic head and a constant sized orifice 81, an essentially constant flow rate of liquid metal can be established.

Typically, a steady state of power is desired so the melt rate is generally equal to the removal rate from the clean metal nucleated casting system 3, as a stream 56. However, the current applied to the clean metal nucleated casting system 3 can be adjusted to provide more or less liquid metal 46 and slag 44 and 83 a above the orifice 81. The amount of liquid metal 46 and slag 44 and 83 above the orifice 81 is determined by the power that melts the ingot, and the cooling of the electroslag refining system 1, which create the skulls. By adjusting the applied current, flow through the orifice 81 can be controlled.

Also, the contact of the consumable electrode 24 with an upper surface of the molten slag 34 can be maintained in order to establish a steady state of operation 1. A rate of consumable electrode 24 descent into the melt 46 can be adjusted to ensure that contact of the consumable electrode 24 with the upper surface of the molten slag 34 is maintained for the steady state operation. Thus, a steady-state discharge from the stream 56 can be maintained in the clean metal nucleated casting system 3. The stream 56 of metal that is formed in the electroslag refining system 1 of the clean metal nucleated casting system 3 exits electroslag refining system 1 and is fed to a nucleated casting system 2. The nucleated casting system 2 is schematically illustrated in FIG. 1 in cooperation with the electroslag refining system 1.

The nucleated casting system 2 comprises a disruption site 134 that is positioned to receive the stream 56 from the electroslag refining system 1 of the clean metal nucleated casting system 3. The disruption site 134 converts the stream 56 into a plurality of molten metal droplets 138. The stream 56 can be fed to disruption site 134 in a controlled atmosphere environment 140 that is sufficient to prevent substantial and undesired oxidation of the droplets 138. The controlled atmosphere environment 140 may include any gas or combination of gases, which do not react with the metal of the stream 56. For example, if the stream 56 comprises aluminum or magnesium, the controlled atmosphere environment 140 presents an environment that prevents the droplets 138 from becoming a fire hazard. Typically, any noble gas or nitrogen is suitable for use in the controlled atmosphere environment 140 because these gases are generally non-reactive with most metals and alloys within the scope of the invention. For example, nitrogen, which is a low-cost gas, can be in the controlled atmosphere environment 140, except for metals and alloys that are prone to excessive nitriding. Also, if the metal comprises copper, the controlled atmosphere environment 140 may comprise nitrogen, argon, and mixtures thereof. If the metal comprises nickel or steel, the controlled atmosphere environment 140 can comprises nitrogen or argon, or mixtures thereof.

The disruption site 134 can comprise any suitable device for converting the stream 56 into droplets 138. For example, the disruption site 134 can comprise a gas atomizer, which circumscribes the stream 56 with one or more jets 142. The flow of gas from the jets 142 that impinge on the stream can be controlled, so the size and velocity of the droplets 138 can be controlled. Another atomizing device, within the scope of the invention, includes a high pressure atomizing gas in the form of a stream of the gas, which is used to form the controlled atmosphere environment 140. The stream of controlled atmosphere environment 140 gas can impinge the metal stream 56 to convert the metal stream 56 into droplets 138. Other exemplary types of stream disruption include magneto-hydrodynamic atomization, in which the stream 56 flows through a narrow gap between two electrodes that are connected to a DC power supply with a magnet perpendicular to the electric field, and mechanical-type stream disruption devices.

The droplets 138 are broadcast downward (FIG. 1) from the disruption site 134 to form a generally diverging cone shape. The droplets 138 traverse a cooling zone 144, which is defined by the distance between the disruption site 134 and the upper surface 150 of the metal casting that is supported by the mold 146. The cooling zone 144 length is sufficient to solidify a volume fraction portion of a droplet by the time the droplet traverses the cooling zone 144 and impacts the upper surface 150 of the metal casting. The portion of the droplet 138 that solidifies (hereinafter referred to as the "solid volume fraction portion") is sufficient to inhibit coarse dendritic growth in the mold 146 up to a viscosity inflection point at which liquid flow characteristics in the mold are essentially lost.

The partially molten/partially solidified metal droplets (referred to hereinafter as "semisolid droplets") collect in mold 146. The mold may comprise a unitary and one-piece mold, as illustrated in the broken lines of FIG. 1. Alternatively, the mold may comprises a withdrawal mold, which includes a retractable base 246 that can be withdrawn from sidewalls of the mold 146. The following description of the invention will discuss a withdrawal mold as an exemplary, non-limiting mold, and is not intended to limit the invention in any manner. The retractable base 246 can be connected to a shaft 241 to move base away from the sidewalls in the direction of arrow 242. Further, the shaft 241 may rotate the retractable base 246 in the direction of arrow 243 to provide most portions of the mold to a cooling system, which is described hereinafter. The semisolid droplets behave like a liquid if the solid volume fraction portion is less than a viscosity inflection point, and the semisolid droplets exhibit sufficient fluidity to conform to the shape of the mold. Generally, an upper solid volume fraction portion limit that defines a viscosity inflection point is less than about 40% by volume. An exemplary solid volume fraction portion is in a range from about 5% to about 40%, and a solid volume fraction portion in a range from about 15% to about 30% by volume does not adversely influence the viscosity inflection point.

The spray of droplets 138 creates a liquidus, upper portion 148 disposed proximate the surface of the casting 145 in the mold 146. The depth of the liquidus, upper portion 148 is dependent on cooling of the liquidus portion, the solidification rate thereof, and various clean metal nucleated casting system 3 factors, such as, but not limited to, the atomization gas velocity, droplet velocity, the cooling zone 144 length, the stream temperature, and droplet size. The liquidus, upper portion 148 can be created with a depth in the mold 146 in a range from about 0.005 inches to about 1.0 inches. An exemplary liquidus, upper portion 148 within the scope of invention comprises a depth in a range from about 0.25 to about 0.50 inches in the mold. In general, the liquidus, upper portion 148 in the mold 146 should not be greater that a region of the casting, where the metal exhibits predominantly liquid characteristics. Typically, expedited solidification of the liquidus portion minimizes gas entrapment and resultant pores in the casting.

A cooling system 500 (FIG. 1), as embodied by the invention, can extract heat from the liquidus portion 148 of the casting 145 to expedite its cooling and enhance its solidification. The cooling system 500 comprises a coolant supply 501. The coolant can comprise any appropriate coolant, such as, but not limited to, an inert cooling gas that will not react with the material of the casting. Exemplary cooling gases within the scope of the invention comprise, but are not limited to, argon, nitrogen, and helium. In the cooling system 500, the coolant is directed onto the liquidus portion of the casting 145, while the casting 145 can be withdrawn from the mold 146, if the mold comprises a withdrawal mold. The coolant exits the cooling system 500 in the form of a spray 503 after passing through a coolant conduit 502 from the coolant supply 501. The coolant conduit 502 can comprise any appropriate conduit that allows passage of the coolant from the coolant source 501 to a position proximate the liquidus portion 148 of a casting 145. The shape and configuration of the coolant conduit 502 may take any shape and configuration as long as the coolant can be directed to the liquidus portion 148 of the casting 145, such as inside the zone 144. While the illustrations set forth the coolant conduit 502 being curved and angled, this shape and configuration is merely exemplary, and is not intended to limit the invention in any manner. Other shapes and configurations of the coolant conduit 502, for example, but not limited to, straight and coiled, are within the scope of the invention.

The cooling system 500, as embodied by the invention, can comprise a configuration as illustrated. Further, the cooling system 500 can comprise a plurality of one or all of the elements of the cooling system 500. For example, and in no way limiting of the invention, the cooling system 500 can comprise one source that is in fluidic communication with a plurality of coolant conduits 502 to form a plurality of sprays 503. Further, the cooling system 500 can comprise a plurality of supplies 501, each communicating with a coolant conduit 502 and coolant spray 503. Also, a coolant conduit 502 may form a plurality of sprays 503 from a single coolant conduit 502. The above descriptions are merely exemplary and are not intended to limit the invention in any manner.

The mold 146 can be formed of any suitable material for casting applications, such as but not limited to, graphite, cast iron, and copper. Graphite is a suitable mold 146 material since it is relatively easy to machine and exhibits satisfactory thermal conductivity for heat removal via the cooling systems, as embodied by the invention. As the mold 146 is filled with semisolid droplets 138, its upper surface 150 moves closer to the disruption site 134, and the cooling zone 144 is reduced. At least one of the disruption site 134 or the mold 146 may be mounted on a moveable support and separated at a fixed rate to maintain a constant cooling zone 144 dimension. Thus, a generally consistent solid volume fraction portion in the droplets 138 is formed. Baffles 152 may be provided in the nucleated casting system 2 to extend the controlled atmosphere environment 140 from the electroslag refining system 1 to the mold 146. The cooling system 500 can extend through the baffles 152, as illustrated in the figures. The baffles 152 can prevent oxidation of the partially molten metal droplets 138 and conserve the controlled atmosphere environment gas 140. Heat that is extracted from the casting 145 completes the solidification process of the liquidus upper portion 148 of the casting 145 to form solidified castings for further use. Sufficient nuclei are formed in casting 145 produced so that upon solidification, a fine equiaxed microstructure 149 can be formed in the casting 145.

The casting system 3 inhibits undesirable dendritic growth, reduces solidification shrinkage porosity of the formed casting and casting, and reduces hot tearing both during casting and during subsequent hot working of the casting and casting. Further, the clean metal nucleated casting system 3 produces a uniform, equiaxed structure in the casting which is a result of the minimal distortion of the mold during casting, the controlled transfer of heat during solidification of the casting in the mold, and controlled nucleation. The clean metal nucleated casting system 3 enhances ductility and fracture toughness of the casting compared to conventionally castings.

Figure 5:
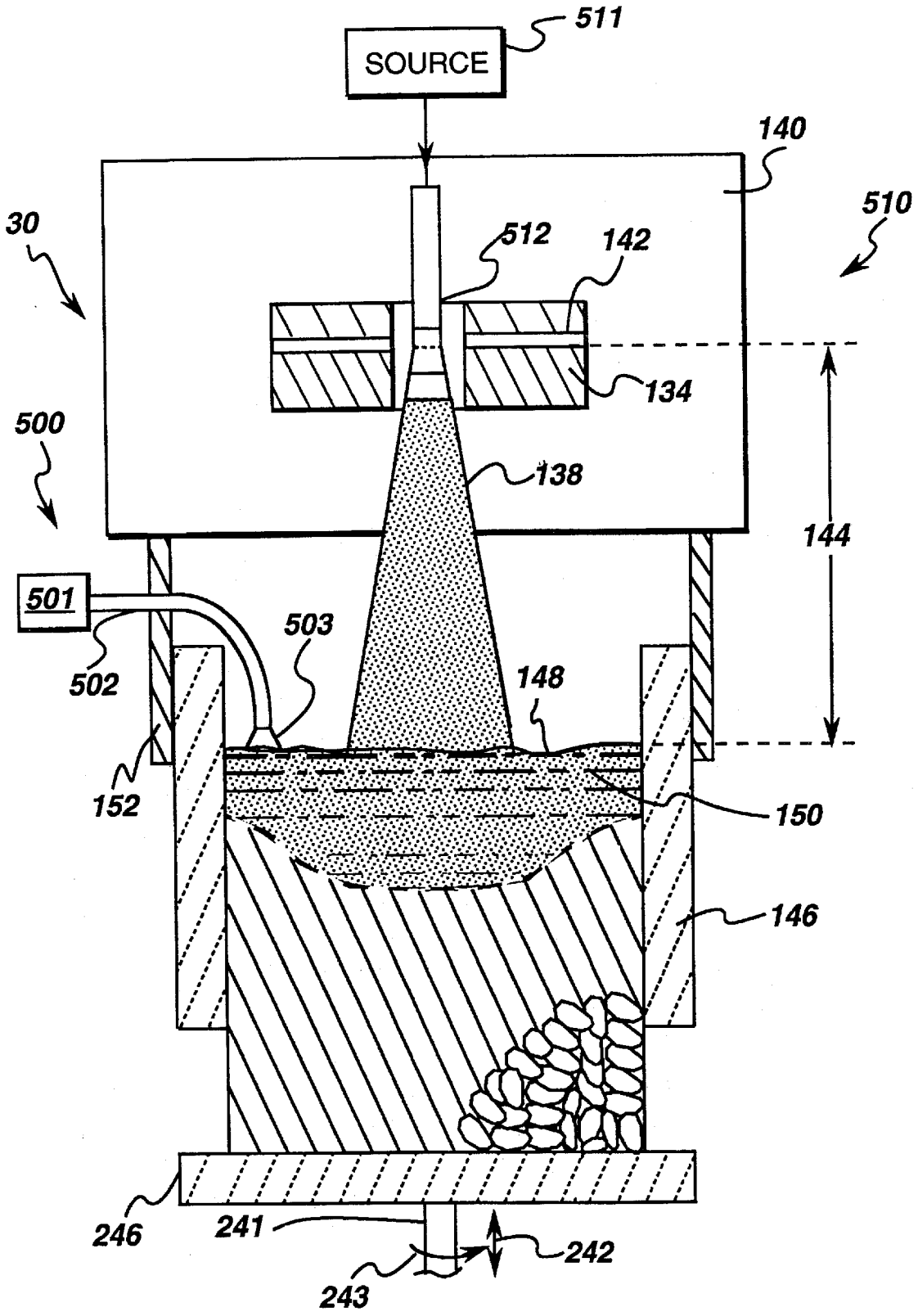
FIG. 5 is a schematic illustration of a further casting system with a nucleated casting system and auxiliary cooling onto a liquidus portion of the casting.

The above-described cooling system 500 has been discussed in regard to a casting system 3, which comprises an electroslag refining system 1 as a source of liquid metal, a nucleated casting system 2, and a cooling system 500. However, the scope of the invention further comprises use of cooling systems, as embodied by the invention, with a casting system that comprises a nucleated casting system with any appropriate source of liquid metal. For example, the supply of liquid metal may comprise a nucleated casting system alone, as illustrated in FIG. 5. The casting system 510 in FIG. 5 comprises a nucleated casting system 2, which is similar to the nucleated casting system in FIGS. 1–4. The nucleated casting system 2 of FIG. 5 is illustrated with a withdrawal mold 146, however, any appropriate mold is within the scope of the invention.

The nucleated casting system 2 comprises a disruption site 134 that is positioned to receive a liquid metal stream 512 from any appropriate source 511. For example, and in no way limiting of the invention, the source 511 of the liquid metal stream may comprise a vacuum arc remelting (VAR) system, a vacuum induction melting (VIM) system, an electroslag refining (ESR) system (as discussed above) with or without a cold induction guide (CIG) system, and other systems that pertain to the purification of crude or impure metals. The above systems are merely exemplary, and are not intended to limit the invention in any manner.

The disruption site 134 converts the liquid metal stream 512 from the source 511 into a plurality of molten metal droplets 138. The stream 512 can be fed to disruption site 134 in a controlled atmosphere environment 140 that is sufficient to prevent substantial and undesired oxidation of the droplets 138. The controlled atmosphere environment 140 may include any gas or combination of gases, which do not react with the metal of the stream 512. For example, if the stream 512 comprises aluminum or magnesium, the controlled atmosphere environment 140 presents an environment that prevents the droplets 138 from becoming a fire hazard.

The disruption site 134 can comprise any suitable device for converting the stream 512 into droplets 138. For example, the disruption site 134 can comprise a gas atomizer, which circumscribes the stream 512 with one or more jets 142. The flow of gas from the jets 142 that impinge on the stream can be controlled, so the size and velocity of the droplets 138 can be controlled. Another atomizing device, within the scope of the invention, includes a high pressure atomizing gas in the form of a stream of the gas, which is used to form the controlled atmosphere environment 140. The stream of controlled atmosphere environment 140 gas can impinge the metal stream 512 to convert the metal stream 512 into droplets 138. Other exemplary types of stream disruption are described above.

The droplets 138 are broadcast downward (FIG. 1) from the disruption site 134 to form a generally diverging cone shape. The droplets 138 traverse a cooling zone 144, which is defined by the distance between the disruption site 134 and the upper surface 150 of the metal casting that is supported by the mold 146. The cooling zone 144 length is sufficient to solidify a volume fraction portion of a droplet by the time the droplet traverses the cooling zone 144 and impacts the upper surface 150 of the metal casting. The partially molten/partially solidified metal droplets (referred to hereinafter as "semisolid droplets") collect in mold 146. The mold may comprise a retractable base 246, which can be withdrawn from sidewalls of the mold 146 so as to define a withdraw mold. The retractable base can be connected to a shaft 241 to move base away from the sidewalls in the direction of arrow 242. Further, the shaft 241 may rotate the retractable base 246 in the direction of arrow 243 to provide most portions of the mold to a cooling system, which is described hereinafter. Details of the remainder of the nucleated casting system 2 are as set forth in the above description.

The casting system 500 provides auxiliary cooling to the directly cooling to the liquidus portion 148 of the casting 145. The auxiliary cooling is in addition to the cooling that occurs during the solidification of the casting 145 itself, for example cooling that occurs by thermal conduction from walls of the mold 146. Thus, a casting system that is provided with a cooling system 500, as embodied by the invention, can form a casting that is essentially oxide free and impurity free, and can also be densely formed and essentially non-porous because few air voids are allowed to cool in the casting due to the enhanced solidification rate resulting from the auxiliary cooling onto a liquidus portion of the casting, as embodied by the invention. Further, the expedited cooling and enhanced solidification rates of the liquidus portion of the casting will enhance the microstructural characteristics of the casting by reducing the grain size, providing an essentially segregation free microstructure, and a homogeneous microstructure.

While various embodiments are described herein, it will be appreciated from the specification that various combinations of elements, variations or improvements therein may be made by those skilled in the art, and are within the scope of the invention.

We claim:

1. A casting system with auxiliary cooling onto a semi-solid portion of the casting for producing a metal casting, the metal casting comprising a fine-grain, homogeneous microstructure that is essentially oxide- and sulfide-free, segregation defect-free, and essentially free of voids caused by air entrapped during solidification of the metal from a semi-solid state to a solid state, the casting system comprising:

an electroslag refining system;

a nucleated casting system; and at least one auxiliary cooling system, comprising a coolant source and a coolant conduit, wherein the conduit is shaped to direct the coolant directly onto the semi-solid portion of the metal casting, so that the semi-solid portion of the casting is cooled in a manner sufficient to provide a casting microstructure that comprises a fine-grain, homogeneous microstructure that is essentially oxide- and sulfide-free, segregation defect-free, and essentially free of voids caused by air entrapped during solidification from a semi-solid state to a solid state.

2. A casting system according to claim 1, wherein the electroslag refining system comprises:

an electroslag refining structure adapted to receive and to hold a refining molten slag, a source of metal to be refined in the electroslag refining structure;

a body of molten slag in the electroslag refining structure, the source of metal being disposed in contact with the molten slag, an electric supply adapted to supply electric current to the source of metal as an electrode and through the molten slag to a body of refined metal beneath the slag to keep the refining slag molten and to melt the end of the source of metal in contact with the slag, an advancing device for advancing the s source of metal into contact with the molten slag at a rate corresponding to the rate at which the contacted surface of the electrode is melted as the refining thereof proceeds, a cold hearth structure beneath tie electroslag refining structure, the cold hearth structure being adapted to receive and to hold electroslag refined molten metal in contact with a solid skull of the refined metal formed on the walls of the cold hearth vessel, a body of refined molten metal in the cold hearth structure beneath the molten slag, a cold finger orifice structure below the cold hearth adapted to receive and to dispense a stream of refined molten metal that is processed by the electroslag refining system and through the cold hearth structure, the cold finger orifice structure having a orifice, a skull of solidified refined metal i n contact with the cold hearth structure and the cold finger orifice structure including the orifice.

3. A casting system according to claim 1, wherein the nucleated casting system comprises:

a disruption site through which a stream of liquid metal is formed into molten metal droplets; and a cooling zone that that receives the molten metal droplets, the molten metal droplets being solidified in the cooling zone into semisolid droplets such that, on average, about 5% to about 40% by volume of each semisolid droplet is solid and the remainder of the semisolid droplet is molten; and a mold that collects the droplets in a semi-solid and solidifies the droplets thereby forsing a casting having a fine-grain, homogeneous microstructure that is essentially oxide- and sulfide-free and segregation defect free, and essentially free of voids caused by air entrapped during solidification of the metal from a semi-solid state to a solid state.

4. A casting system according to claim 2, wherein the nucleated casting system comprises:

a disruption site through which a stream of liquid metal is formed into molten metal droplets; and a cooling zone that that receives the molten metal droplets, the molten metal droplets being solidified in the cooling zone into semisolid droplets such that, on average, about 5% to about 40% by volume of each semisolid droplet is solid and the remainder of the semisolid droplet is molten; and a mold that collects the droplets in a semi-solid portion and solidifies the droplets thereby forming a casting having a fine-grain, homogeneous microstructure that is essentially oxide- and sulfide-free and segregation defect free, and essentially free of voids caused by air entrapped during solidification of the metal from semi-solid state to a solid state, and the cooling system comprises a coolant that is applied onto a semi-solid portion of the casting.

5. A casting system according to claim 1, wherein the semi-solid portion of the casting is generated by metal droplets in an upper area of the casting and, within the semi-solid portion, on average, less than about 50% by volume of an average droplet is solid.

6. A casting system according to claim 1, wherein the coolant conduit applies coolant as a spray.

7. A casting system according to claim 1, wherein the casting comprises at least one of nickel-, cobalt-, titanium-, or iron-based metals.

8. A casting system according to claim 1, wherein the casting comprises a turbine component.

9. A casting system with auxiliary cooling onto a semi-solid portion of the casting for producing a metal casting, the metal casting comprising a fine-grain, homogeneous microstructure that is essentially oxide- and sulfide-free, segregation defect-free, and essentially free of voids caused by air entrapped during solidification of the metal from a semi-solid state to a solid state, the casting system comprising:

a source of liquid metal;

a metal disruption site through which a stream of the liquid metal is formed into molten metal droplets; and a cooling zone that receives the molten metal droplets, the molten metal droplets being solidified in the cooling zone into semisolid droplets such that, on average, about 5% to about 40% by volume of each semisolid droplet is solid and the remainder of the semisolid droplet is molten; and a mold that collects the droplets in a semi-solid portion and solidifies the droplets, thereby forming a casting having a fine-grain, homogeneous microstructure that is essentially oxide- and sulfide-free and segregation defect-free, and essentially free of voids caused by air entrapped during solidification of the metal from a semi-solid state to a solid state, and an auxiliary cooling system that supplies coolant onto a semi-solid portion of the casting in a manner sufficient to cool the semi-solid portion of the metal casting, wherein the semi-solid portion of the metal casting is cooled in a manner sufficient to provide a casting microstructure that comprises a fine-grain, homogeneous microstructure that is essentially oxide- and sulfide-free, segregation defect-free, and essentially free of voids caused by air entrapped during solidification from a semi-solid state to a solid state.

10. A system according to claim 9, wherein the system according to claim 1, wherein the auxiliary cooling system comprises:

a coolant supply and a coolant conduit to apply coolant directly onto a semi-solid portion of the casting.

11. A system according to claim 9, wherein the coolant conduit applies the coolant to at least one of a casting mold and casting in the form of a spray.

12. A system according to claim 9, wherein the casting comprises at least one of nickel-, cobalt-, titanium-, or iron-based metals.

13. A system according to claim 9, wherein the casting comprises a turbine component.

14. A casting method with auxiliary cooling onto a semi-solid portion of the casting for forming a metal casting, the metal casting comprising a fine-grain, homogeneous microstructure that is essentially oxide- and sulfide-free, segregation defect free, and essentially free of voids caused by air entrapped during solidification of the metal from a semi-solid state to a solid state, the method with auxiliary cooling onto a semi-solid portion of the casting comprising:

forming a source of clean refined metal that has oxides and sulfides refined out by electroslag refining;

forming a casting by a nucleated casting process; and cooling a semi-solid portion of the casting, the step of cooling comprises directing coolant onto the semi-solid portion of the casting, wherein the step of cooling is sufficient to provide a casting microstructure that comprises a fine-grain, homogeneous microstructure that is essentially oxide- and sulfide-free, segregation defect free, and essentially free of voids caused by air entrapped during solidification from a semi-solid state to a solid state.

15. A method according to claim 14, wherein the step of forming a source comprises electroslag refining that comprises:

providing a source of metal to be refined;

providing an electroslag refining structure adapted for the electroslag refining of the source of metal and providing molten slag in the vessel;

providing a cold hearth structure for holding a refined molten metal beneath the molten slag and providing refined molten metal in the cold hearth structure;

mounting the source of metal for insertion into the electroslag refining structure and into contact with the molten slag in the electroslag refining structure;

providing an electrical power supply adapted to supply electric power;

supplying electric power to electroslag refine the source of metal through a circuit, the circuit comprising the power supply, the source of metal, the molten slag and the electroslag refining structure;

resistance melting of the source of metal where the source of metal contacts the molten slag and forming molten droplets of metal;

allowing the molten droplets to fall through the molten slag;

collecting the molten droplets after they pass through the molten slag as a body of refined liquid metal in the cold hearth structure directly below the electroslag refining structure;

providing a cold finger orifice structure having a orifice at the lower portion of the cold hearth structure; and draining the electroslag refined metal that collects in the cold hearth orifice structure through the orifice of the cold finger orifice structure.

16. A method according to claim 15, wherein the source of metal comprises an alloy selected from at least one of nickel-, cobalt-, titanium-, or iron-based metals, and the casting formed by the clean metal nucleated casting process comprises at least one of nickel-, cobalt-, titanium-, or iron-based metals.

17. A method according to claim 15, wherein a rate of advance of the source of metal into the refining structure corresponds to the rate of resistance melting.

18. A method according to claim 15, wherein the step of draining comprises forming a stream of molten metal.

19. A method according to claim 15, wherein the electroslag refining structure and the cold hearth structure comprise upper and lower portions of the same structure.

20. A method according to claim 15, wherein the step of supplying electric power comprises forming a circuit in the refined liquid metal.

21. A method according to claim 15, wherein the step of draining comprises establishing a drainage rate that is approximately equivalent to a rate of resistance melting.

22. A method according to claim 15, wherein the step of forming a casting comprises:

disrupting a stream of clean metal from the source of clean metal into molten metal droplets;

partially solidifying the molten metal droplets such that, on average, from about 5% to about 40% by volume of each droplet is solid and the remainder of each droplet is molten; and collecting and solidifying the partially solidified droplets in a mold forming the casting, in which a turbulent zone is generated by the droplets at an upper surface and, the step of collecting and solidifying the partially solidified droplets collects the droplets in the turbulent zone, and, on average solidifies less than about 50% by volume of the droplet.

23. A method according to claim 22, wherein the step of partially solidifying the molten metal droplets solidifies, on the average, from about 15% to about 30% by volume of the droplet.

24. A method according to claim 22, wherein the step of collecting and solidifying the partially solidified droplets comprises collecting and solidifying about 5% to about 40% by volume of the droplet.

25. A method according to claim 22, wherein the step of disrupting comprises impinging at least one atomizing gas jet on the stream.

26. A method according to claim 15, wherein the step of electroslag refining comprises:

providing a source of metal to be refined, providing an electroslag refining structure adapted for the electroslag refining of the source of metal and providing molten slag in the vessel, providing a cold hearth structure for holding a refined molten metal beneath the molten slag and providing refined molten metal in the cold hearth structure, mounting the source of metal for insertion into the electroslag refining structure and into contact with the molten slag in the electroslag refining structure, providing an electrical power supply adapted to supply electric power, supplying electric power to electroslag refine the source of metal through a circuit, the circuit comprising the power supply, the source of metal, the molten slag and the electroslag refining structure;

resistance melting of the source of metal where the source of metal contacts the molten slag and forming molten droplets of metal, allowing the molten droplets to fall through the molten slag, collecting the molten droplets after they pass through the molten slag as a body of refined liquid metal in the cold hearth structure directly below the electroslag refining structure, providing a cold finger orifice structure having a orifice at the lower portion of the cold hearth structure, and draining the electroslag refined metal that collects in the cold hearth orifice structure through the orifice of the cold finger orifice structure, and the step of forming a casting comprises:

disrupting a stream of clean metal from the source of clean metal into molten metal droplets;

partially solidifying the molten metal droplets such that, on average, from about 5% to about 40% by volume of each droplet is solid and the remainder of each droplet is molten; and collecting and solidifying the partially solidified droplets in a mold forming the casting, in which a turbulent zone is generated by the droplets at an upper surface and, the step of collecting and solidifying the partially solidified droplets collects the droplets in the turbulent zone, and, on average solidifies less than about 50% by volume of the droplet.

27. A method according to claim 15, wherein the step of cooling comprises providing an auxiliary cooling system that comprises a coolant supply and a coolant conduit, the step of cooling further comprises applying coolant onto a semi-solid portion of the casting.

28. A method according to claim 15, wherein the step of cooling comprises applying coolant in the form of a spray.

29. A casting method with auxiliary cooling onto a semi-solid portion of the casting for forming a metal casting, the metal casting comprising a fine-grain, homogeneous microstructure that is essentially oxide and sulfide-free, segregation defect-free, and essentially free of voids caused by air entrapped during solidification of the metal from a semi-solid state to a solid state, the method comprising:

forming a source of clean refined metal that has oxides and sulfides refined out by electroslag refining;

forming a casting by nucleated casting; and cooling a semi-solid portion of the metal casting by applying a coolant directly onto a semi-solid portion of the casting, wherein the step of cooling is sufficient to cool the semi-solid portion of the metal casting to provide a microstructure that comprises a fine-grain, homogeneous microstructure that is essentially oxide- and sulfide-free, segregation defect-free, and essentially free of voids caused by air entrapped during solidification from a semi-solid state to a solid state.

30. A casting system according to claim 1, wherein the conduit is shaped to direct the coolant directly onto the upper surface of the semi-solid portion of the metal casting.

* * * * *